United States Patent [19]

Phillips

[11] Patent Number: 4,509,566

[45] Date of Patent: Apr. 9, 1985

[54] SEPARATORY FUNNEL AND VALVE DEVICE

[76] Inventor: Edwin D. Phillips, 700 Cedar Ave., Middlesex, N.J. 08846

[21] Appl. No.: 515,860

[22] Filed: Jul. 21, 1983

[51] Int. Cl.[3] ..... B01L 3/00

[52] U.S. Cl. ..... 141/94; 141/301; 141/363; 210/91; 210/95; 210/515; 222/46; 222/422

[58] Field of Search ..... 141/94, 298, 301, 363; 222/510, 519, 549, 420, 421, 422, 48, 46; 210/514, 515, 95, 800, 539, 91; 604/251; 251/264, 273

[56] References Cited

U.S. PATENT DOCUMENTS

| | | | |
|---|---|---|---|
| 474,674 | 5/1892 | Miller | 141/298 |
| 482,578 | 9/1892 | Kiefer | 141/298 |
| 2,344,485 | 3/1944 | Adams | 210/514 |
| 2,526,784 | 10/1950 | Walker | 141/94 X |
| 2,542,461 | 2/1951 | Bay | 604/251 X |
| 2,614,531 | 10/1952 | Futterer | 222/420 X |
| 2,720,343 | 10/1955 | Ross et al. | 222/420 X |
| 2,782,964 | 2/1957 | Wilding | 222/422 |
| 3,108,716 | 10/1963 | Panek et al. | 222/48 |
| 3,356,335 | 12/1967 | Koch et al. | 251/273 X |
| 3,370,761 | 2/1968 | Kontes et al. | 222/422 |
| 3,865,023 | 2/1975 | Halvorsen | 210/800 X |
| 3,990,403 | 11/1976 | Jacobs | 222/420 X |
| 4,389,926 | 6/1983 | Joyner | 210/514 X |

FOREIGN PATENT DOCUMENTS

| | | | |
|---|---|---|---|
| 0971045 | 11/1958 | Fed. Rep. of Germany | 222/422 |

*Primary Examiner*—Stephen Marcus
*Assistant Examiner*—Mark Thronson
*Attorney, Agent, or Firm*—Shoemaker and Mattare, Ltd.

[57] ABSTRACT

A separatory funnel having a valve stem mounted through its center to accurately open, close, and regulate the flow of liquid from the funnel. The valve stem is provided with a passageway therein for forming a separate channel from the path of liquid flow to permit air to pass through the separatory funnel independently of the liquid flow from the funnel. This air passageway may exit internally of the funnel chamber, or externally thereof. In the external exit version, the valve stem is modified so that the air exit path can be capped and/or connected to another device. The lower end of the valve stem is provided with sealing structure of several types for assuring a tight and positive seal when the valve is closed. Also, the lower end of the valve stem is sandblasted to effect flow of all liquid therealong and tapered to a spherical ball at the very end for collecting and forming liquid droplets for precision liquid flow measurement. Another embodiment eliminates the roughened surface, but provides an insert bushing for both sealing the liquid flow as well as assuring the flow of the liquid to the very tip of the valve stem. Graduated markings can be provided on either the external surface of the funnel chamber or the external surface of the valve stem. Indicia may also be provided on the adjusting knob for the valve stem to permit accurate liquid flow control and repeatability of adjustment thereof.

22 Claims, 7 Drawing Figures

SEPARATORY FUNNEL AND VALVE DEVICE

BACKGROUND OF THE INVENTION

1. Field of the Invention

This invention relates generally to separatory funnel devices having valve structure therewith for accurately controlling the dispensation of liquid therefrom.

2. Description of the Prior Art

A common problem with known devices for dispensing and separating liquids using what is known as "separatory funnels" is that in order to transfer liquid from one container to another, the pressure of the two containers must be equalized. Oftentimes air must be allowed to escape from the second container through the funnel structure. To do this a separate channel must be provided so as not to interfere with the flow of liquid from the funnel or regulatory device. In known type devices this comprises a separate tube commonly termed "a side arm" which is attached below the control valve to near the top of the funnel so as to be above the liquid level therein. This tube is generally made of glass. Such a side arm is relatively expensive to manufacture and attach, is easily broken, and quite impossible to clean.

Another problem with known type devices for use as separatory funnels is that the valve structure thereof is basically an on-off valve, rather than a flow control valve. Thus, while the liquid flow can be turned on and off, it is generally quite difficult to accurately and precisely regulate the liquid flow and/or accurately and precisely determine the amount of fluid flow therefrom.

Existing prior patents which may be pertinent to the present invention are as follows:

| | | |
|---|---|---|
| 272,379 | J. W. Fenner | 2/13/1883 |
| 2,608,993 | H. Andrews | 9/2/52 |
| 2,670,008 | G. Kopp | 2/23/54 |
| 3,257,170 | M. Marcus et al | 6/21/66 |
| 4,080,965 | T. E. Phillips | 3/28/78 |
| 4,230,300 | H. L. Wiltse | 10/28/80 |

These patents show valve structure for controlling the dispensing of liquid from a container. The Fenner patent has an oil-feed regulating stem b with an oil flow slot therein c. However, this device does not have structure for permitting air or gas flow in a path separate from the oil flow path. The Andrews and Kopp patents show manually adjustable control valves provided with manually actuable structure for controlling the liquid flow past the valves. The Marcus et al patent is for liquid separatory apparatus wherein the valve plug 26 has a transverse bore 36 for liquid flow therethrough and bores 46, 48 for air flow therethrough. However, the overall structural arrangement of this device is entirely different from that of the present invention. The Phillips patent shows an in-line valve assembly for controlling the flow of blood between two containers. The cannula element can be positioned to either a closed position or a flow permitting position. The Wiltse patent shows a flow metering and shut-off valve wherein the valve has spaced seals so that contamination cannot be transferred through the structure when fluid is being introduced into a living person. These patents all show various valve flow and control structures; however, none of the known prior art devices offer the new and novel features of the present invention.

SUMMARY OF THE INVENTION

An object of the present invention is to provide a valve within a separatory funnel having structure at one end thereof associated with a funnel liquid outlet for controlling the flow of liquid therefrom.

Another object of the present invention is to provide a valve for a separatory funnel which permits fluid flow; i.e. air or other gas, through the valve separate from the path of liquid flow.

A further object of this invention is to provide adjusting structure with the valve so that the liquid flow controlled thereby can be accurately and precisely regulated as desired by a user of the separatory funnel.

A still further object of the present invention is for structure arranged at the end of the valve for forming drops of liquid, the flow of which is being controlled by the valve so that precise liquid measuring can be effected by the device.

The purpose of the present invention is to eliminate several problems inherent in the structure of known type separatory funnels with valve structure, and also to produce greater flexibility of the separatory funnel use without structural changes to the complicated and expensive basic structure thereof.

Another purpose of the present invention is to provide a positive liquid shut-off plus a very accurate and precise liquid flow control. While known type separatory funnels provide a separate air or gas path by use of a separate glass tube outside of the main funnel itself, this arrangement is expensive, the glass tube is very easily broken, and almost impossible to clean. Therefore, an important feature of the present invention is to elimiante this external fluid passageway. In the present device, a hollow valve stem provides a separate air passage from that of the liquid flow being controlled by the valve. In addition, it has been discovered that this separate fluid passage can also be used to introduce an additional liquid or gas independently into the original system so that more than one liquid or gas can be controlled.

The present separatory funnel includes an elongated valve stem having a separate passageway through the center thereof which is separate and independent of the primary valve liquid controlling function as effected by the outside of one end of the elongated valve stem.

Also, the tip end of the elongated valve stem is provided with a formed lip or spherical ball for efficiently collecting and forming drops of liquid. By this structure, it is possible to control all of the liquid flow and very accurately and precisely determine the amount of such flow.

Also, while in the preferred embodiment the air or fluid aperture through substantially the length of the valve stem terminates short of the upper end of the valve stem and within the enlarged chamber of the separatory funnel itself, a modification of the device provides for the aperture to extend the entire length of the elongated valve stem. This permits the upper end of the valve stem to be either capped and/or connected to another liquid or fluid dispensing source.

It has also been discovered that while in the primary embodiment of the present invention a seal of O-ring construction is mounted externally of the lower end of the elongated valve stem for engagement with a complementary internal flange surface of the separatory funnel, this structure can be substantially reversed. That is, the sealing end of the valve stem is provided with a smooth tapered surface which engages with an insert bushing mounted within the separatory funnel, which bushing functions as a sealing member in conjunction with the tapered surface of the valve stem.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENT(S)

Figure 1:
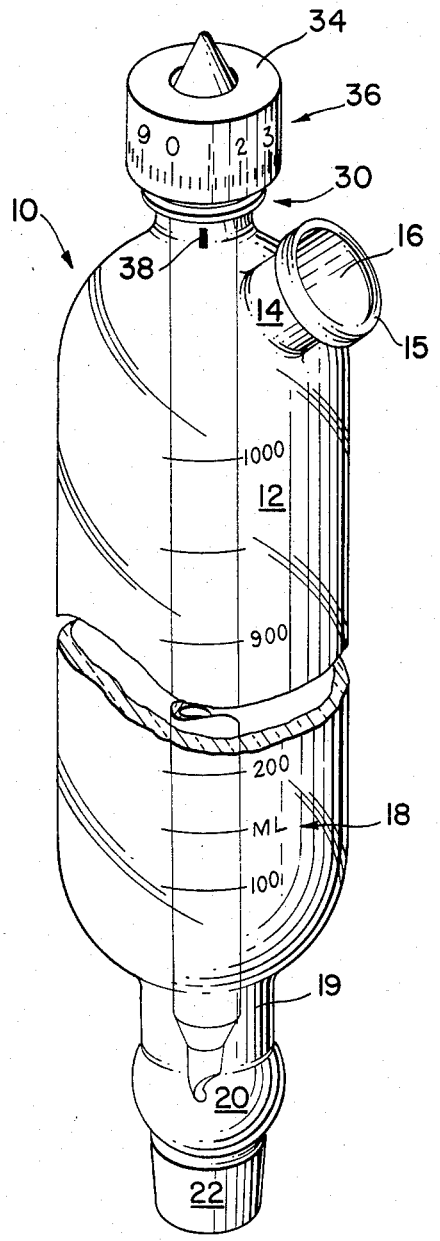
FIG. 1 is a perspective view of the separatory funnel and valve structure of the present invention.
Figure 2:
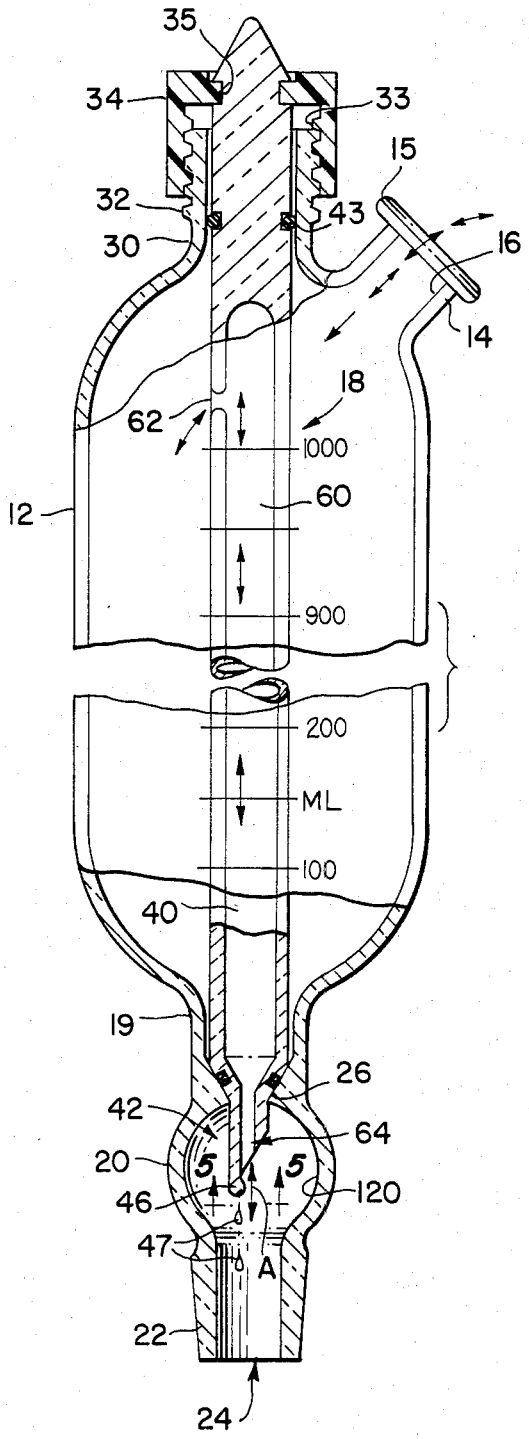
FIG. 2 is an elevational view, partly in cross-section, of the separatory funnel and valve structure of the present invention.

Looking at FIG. 1 of the drawings, reference numeral 10 indicates in general the device of the present invention. Both FIGS. 1 and 2 show all of the parts of the separatory funnel with valve structure and the standard configuration of the funnel portion. An enlarged enclosed chamber 12 has an extension 19 at the lower end thereof connecting to a smaller enlarged spherical portion 20. Extending from the lower end of the spherical portion is a flask or container engaging extension 22. An inlet or entry port 14 for liquid is provided near the upper end of chamber 12. This inlet has a tapered inner circumference 16 for reception of a stopper or other type closure. A rolled bead 15 provides strength for inlet 14, as well as safety from sharp edges. This inlet can also function as part of the separate air passage as shown by arrows A—A—A.

An elongated valve stem 40 is attached to the funnel through another opening 30 at the top of the separatory funnel. This opening 30 is provided with external threads 32 over most of the external surface thereof. A knob 34 mounted on the upper end of the elongated valve stem is provided with internal threads 33 which complement and mate with external threads 32 of the funnel.

Figure 3:
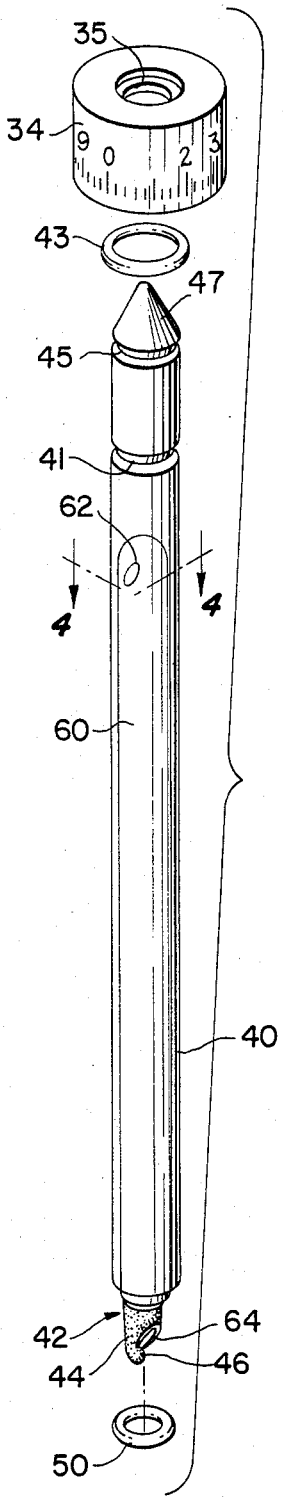
FIG. 3 is an exploded perspective of the valve structure and control knob per se of the device of FIGS. 1 and 2.
Figure 4:
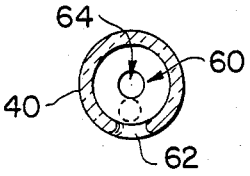
FIG. 4 is a view taken along lines 4—4 of FIG. 3.
Figure 5:
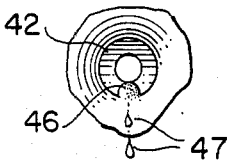
FIG. 5 is a view taken along lines 5—5 of FIG. 2.

Looking at FIG. 3, the individual parts of the elongated valve stem can be clearly seen in detail. The elongated valve stem 40 has an O-ring seal 50 mounted at the lower end thereof. This seal 50 functions as the shut-off portion of the valve and is made from any resilient material having the necessary chemical resistance required for any liquids to be dispensed from the funnel. The valve stem itself is preferably made of glass, or other non-porous material. At the other end of the elongated valve stem 40 spaced grooves 41 and 45 are provided. The groove 41 receives another sealing O-ring 43 of similar construction to that of O-ring 50. The knob or cap 34 already mentioned is preferably made of semi-resilient plastic and is assembled onto the upper end of elongated valve stem 40 by forcing the knob or cap onto the conical stem end 47. This conical end 47 functions as a cam to expand and distort the flexible plastic inner shoulder 35 until the shoulder drops into the groove 45 as shown in FIG. 2. The purpose of this flange 35 and groove 45 configuration is to permit the knob 34 to rotate for effecting longitudinal adjustment of the elongated valve stem 40, but yet not to effect any rotation of the valve stem itself. The upper seal 43 has a two-fold function. In addition to its function as a seal to prevent egress of liquid along the upper portion of the valve stem, this seal also provides friction between the valve stem 40 and the inner neck portion of the funnel for resisting rotation of the stem as the knob 34 is rotated on the threads. Thus, because of the tongue and groove configuration of the knob and stem, and the frictional resistance of the O-ring 43, the cap or knob can be rotated for adjustment of the valve stem lower seal 50, and yet not rotate the stem axially. The reason for this is that it is very desirable to avoid rotation of the valve stem since eccentricity between the stem and threads could effect the space 26 (FIGS. 2 and 6) as the valve stem is longitudinally adjusted and thus change the flow rate of the liquid from the funnel. Since this device is designed to provide very accurate and precise flow rate, it is imperative that no slight inaccuracies or eccentricities of the funnel internal outlet and/or lower valve stem external surface affect the liquid flow rate.

Figure 6:
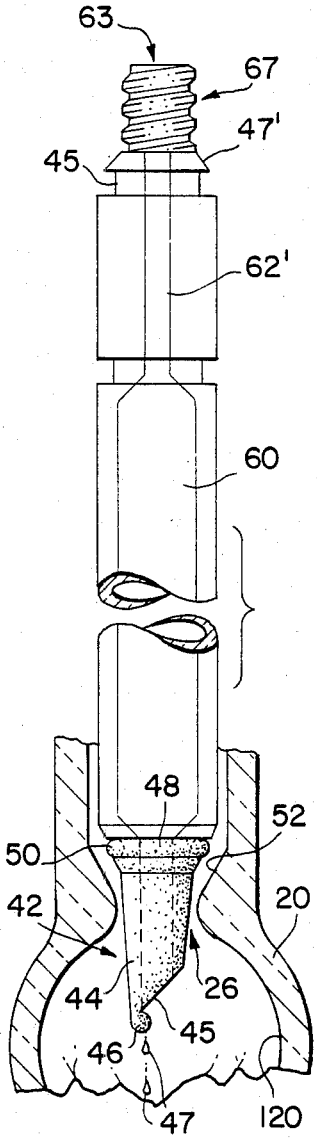
FIG. 6 is a fragmentary portion, partly in cross-section, of a modified embodiment of the invention.

The lower end of FIGS. 2 and 6 show the function of the valve stem for closing, opening and controlling the liquid flow rate. In this preferred embodiment of the invention, i.e. FIG. 2, the lower end 42 of the valve stem has a tapered portion extending to a formed lip or sphere 46 at the very tip thereof. A slanted portion 45 assures that all liquid flowing along the outside of the tip will be collected on the ball or sphere 46 so that the liquid will collect into drops 47. Of course, once formed into drops, these can be counted as they fall for very accurate measuring of the amount of liquid flow. By adjusting knob 34, the tip 42 can be moved upwardly to provide a space 26 between the flared tip, the sealing O-ring 50, and the tapered inner surface 52 of the lower end of extension 19. The liquid flow will be dependent upon the variation of space 26. Knob 34 may be provided with a scale or indicia 36 and opening 30 with mark 38, as shown in FIGS. 1 and 3, for accurately adjusting the liquid flow, and to enable accurately repeating with precision this setting.

As shown in FIGS. 2 and 3, an elongated passageway is provided over a substantial internal portion of the elongated valve stem 40. This passageway 60 exits at the lower end into smaller aperture 64 and at the upper end, in the preferred embodiment, through transverse aperture 62. Thus, a flow path A—A—A for fluid, air or gas is provided separate and distinct from the liquid flow path externally of the valve stem at the lower end thereof.

Upon testing the present invention, it was discovered that with a perfectly smooth outer surface of the lower end of the valve, liquid flowing past the valve seal when open would tend to run down the outside of the stem end, and in some cases, not flow along the angled portion 45 to the very tip of the stem. The structure was improved by adding the spherical portion 46 to the tip end of the valve stem, which increased the degree of droplet formation.

In one preferred use of the funnel of the present invention, it is very desirable to accurately measure a very small flow rate from the funnel. In order to do this, the valve is opened a very small amount, which allows only a small liquid flow down the valve stem. This small flow then forms droplets 47 at the spherical tip 46. If the number of drops per unit of time are counted, an accurate flow rate can be determined. However, for this to be valid, all of the liquid must form at the spherical tip 46 and none of the liquid allowed to run down the polished inner surface of the spherical portion 20 of the funnel.

In further testing it was found that most of the liquid ran down the polished inner surface 120 of the spherical portion of the funnel. Therefore, the external surface 44 of the valve stem was sandblasted from the groove 48 for the O-ring 50 to the spherical ball 46. Apparently, this effected a sufficiently rough glass surface to lower the surface tension of the liquid flowing thereby, thus creating a path of least resistance so that with small liquid flow rates all of the liquid now flows down the valve stem and drops off at tip 46. None of the liquid at small liquid flow rates now follows the inner surface 120 of the glass sphere 20 of the funnel. Another feature of the spherical portion 20 of the funnel is that it permits visual observation of the liquid flow, and the counting of the droplets 47 is very easy.

In the preferred embodiment of FIGS. 1–5, a graduated scale 18 is provided on the outer surface of the chamber 12. This permits accurate filling of the funnel through inlet 14, and also allows precision dispensing of liquid through the valve structure described above.

FIG. 6 shows another embodiment of the present invention wherein the elongated passageway 60 is extended by aperture 62' to the upper end of the elongated valve stem. Aperture 62' exits at opening 63 at the upper end of the valve stem. Also, another modification of this embodiment is the changing of conical portion 47 into a shortened version 47', and then providing a threaded extension 67 for the rest of the upper end of the valve stem. The shortened conical portion 47' still permits the knob 34 to be installed with the tongue 35 and groove 45 configuration as before; however, a closing cap (not shown) can be screwed onto threaded extension 67 to seal off the air passageway 60, 62', 64 when desired, or the valve stem can be attached to another device in order to separately introduce either another liquid or fluid, such as a catalyst or a gas, into passageway 60.

Figure 7:
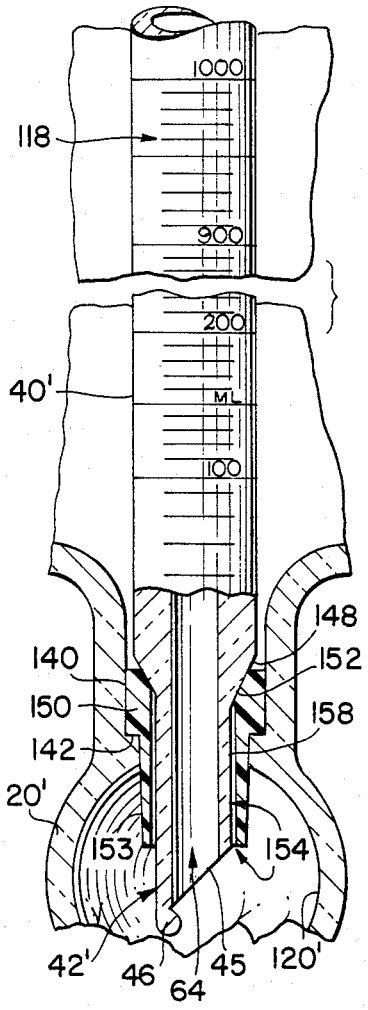
FIG. 7 is a fragmentary portion, partly in cross-section, of a further embodiment of the present invention.

FIG. 7 shows a further embodiment of the present invention. In this embodiment a modification is made to the sealing O-ring and the valve seat. In this embodiment the sealing structure is substantially reversed. The O-ring groove 48 of the preceding embodiment is eliminated and a tapered conical portion 148 is provided at the lower end of the elongated valve stem 40'. This conical portion extends into a straight extension 158. The funnel is provided with an enlarged recess 140 with a formed seat 142 for receiving a bushing 150 removably mounted therewithin. This bushing 150 is made of resilient plastic, such as Teflon, which can be machined separately from the funnel. The bushing is press fitted into the funnel to form a leak-tight joint between the inner glass surface and the outer bushing surface. This bushing is provided with a conical inner surface 152 at the upper end thereof for complementary mating with conical tip 148 of the valve stem. Thus, the valve can effect closing, opening, and flow control of the liquid very positively.

In order to force all the liquid flowing past surfaces 148 and 152 when the valve stem is open to follow the desired path, a skirt 153 is provided on the bushing 150. Thus, the liquid flowing through the valve is forced to follow the path provided by the space 154. Preferably the skirt 153 is made of sufficient length to prevent any of the liquid from contacting the inner surface 120' of the funnel spherical portion 20'. Therefore, all of the liquid must run down the lower end of the valve stem to the point 46 and drop from this point, again permitting very accurate counting and precision measuring of the liquid flow.

In this embodiment of the invention, the volumetric scale, instead of being provided on the outside of the funnel itself, which is relatively difficult and expensive, is instead provided on the valve stem 40' as indicated at 118 in FIG. 7. Since the chamber 12 of the funnel is transparent, i.e. glass or the like, it is very easy to read the graduation marks as provided on the outside diameter of the valve stem.

The present invention has a number of new and novel features, among them a graduation scale on either the outside of the funnel, or on the elongated valve stem as contained within the funnel, a formed lip or bead portion at the lower end of the valve stem to collect in droplets all liquid flowing at a small rate from the valve when slightly open, a clear window spherical portion at the lower end of the funnel permitting easy visual counting of the droplets, a roughened portion on the lower end of the valve stem to lower the surface tension thereof for assuring that all of the liquid flowing from the valve stem collects at the drop-off point, and an alternate structure for positively sealing and stopping liquid flow at the lower end of the valve stem.

Also, further features include the precision adjusting knob which can rotate relatively freely of the valve stem so that distortions thereof and/or distortions of the inner portions of the funnel flow path will not create inaccuracies in flow rate, and an alternate fluid path separate from the liquid flow path for permitting air to freely flow between the funnel and a container receiving liquid dispensed therefrom.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A separatory funnel comprising:

an enlarged enclosed chamber for holding liquids to be accurately dispensed therefrom;

an inlet opening for the chamber;

an outlet opening for the chamber;

an elongated valve stem movably mounted within said chamber;

means at one end of said valve stem associated with said chamber outlet opening to control the flow of liquid therefrom; and further means integral with said valve stem to permit fluid flow through the stem separate from the path of controlled liquid flow from said chamber outlet opening.

2. The funnel of claim 1, further including adjusting means at the other end of said valve stem to accurately regulate said flow control means.

3. The funnel of claim 1, further including means at said one end of the valve stem to form drops of the liquid being dispensed for the purpose of precision measuring of the controlled liquid flow.

4. The funnel of claim 1, wherein the control means at one end of said valve stem includes a deformable valve seat between the exterior of the valve stem and the interior of the chamber outlet opening.

5. The funnel of claim 4, wherein said deformable valve seat includes an O-ring seated in a tapered portion of the valve stem, and the chamber outlet opening has an inwardly projecting reduced mouth area for sealing engagement by said O-ring when the valve stem is in a fully closed position.

6. The funnel of claim 4, wherein said deformable valve seat comprises a tapered external portion near the tip end of the valve stem, and the chamber outlet has a replaceable insert seat installed therewith.

7. The funnel of claim 6, wherein said insert seat is provided with an extension portion slightly larger in internal size than the external size of the tip end of the valve stem.

8. The funnel of claim 2, wherein said adjusting means includes the other end of said valve stem extending out of the chamber through another opening thereto, and a knob being mounted on the end of the stem outside of the chamber.

9. The funnel of claim 8, further including coupling means between said knob and the another chamber opening, and means for resisting valve stem rotation when said liquid flow is being adjusted by the knob through the coupling means.

10. The funnel of claim 9, wherein said coupling means includes the knob having internal threads therein, said another chamber opening having external threads engageable thereby, said means for resisting stem rotation includes sealing means between said another chamber opening and the valve stem, and further means with the knob for indicating a desired flow control setting thereof.

11. The funnel of claim 3, wherein said means for forming drops of liquid includes a spherical ball at the very tip end of said one end of the elongated valve stem.

12. The funnel of claim 1, wherein said further means with said valve stem to permit fluid flow through the stem separate from the path of controlled liquid flow from said chamber outlet opening includes a passageway through the valve stem from said one end towards the other end of said valve stem.

13. The funnel of claim 12, wherein said other end of the valve stem is provided with a transverse opening extending externally of the stem to the passageway internally thereof.

14. The funnel of claim 12, wherein said passageway extends completely through the elongated valve stem from one end to the other thereof.

15. The funnel of claim 14, wherein said other end of said valve stem is provided with means for capping and/or connecting the central passageway therethrough to another unit.

16. The funnel of claim 15, wherein said valve stem is provided with marking graduations thereon which are easily viewable by a user through the chamber.

17. The funnel of claim 1, wherein said chamber is made of transparent material so that marking graduations can be provided on the valve stem which are easily visible therethrough.

18. The funnel of claim 1, wherein said body is made of relatively transparent material, and is further provided with graduations thereon for accurately gauging the amount of contents therewithin.

19. A separatory funnel for use in accurately measuring and dispensing liquids comprising a main funnel body of enlarged cross-section, one end of said body being provided with a projecting outlet portion with a first opening for liquid flow from the main funnel body, said outlet portion having a tapered outer end for mounting the funnel on beakers, flasks or the like, the other end of said body provided with an internally tapered opening for receiving a closure stopper therewithin, another opening in said body in axial alignment with the longitudinal axis of the first opening, an elongated valve stem slidably mounted in said another opening and having one end extending into the mouth of the first opening for controlling liquid flow from the body, the other end of said elongated valve stem provided with adjusting means at said another opening together with sealing means, means at the tip end of the one end of said valve stem for effecting efficient liquid flow therefrom, and wherein said means for effecting efficient liquid flow from the tip end of the valve stem includes a roughened surface externally of the one end of said valve stem together with a spherical ball formed on the very end thereof so that liquid running down the valve stem will all flow along the valve stem to the spherical ball and drop off therefrom in the form of countable droplets.

20. The funnel of claim 19, wherein said one end of the valve stem has valve sealing means associated therewith for permitting sealing closure and complete stoppage of liquid flow from the separatory funnel when desired.

21. The funnel of claim 19, wherein said adjusting means provided with the other end of said valve stem includes marking indicia for permitting accurate and precise resetting of flow control of the valve stem when desired by a user of the device.

22. The funnel of claim 19, together with further means with the elongated valve stem for permitting fluid flow therethrough in a separate path from the controlled liquid flow path of the main funnel body.

* * * * *